US006186002B1

(12) United States Patent
Lieberman et al.

(10) Patent No.: US 6,186,002 B1
(45) Date of Patent: Feb. 13, 2001

(54) METHOD FOR DETERMINING COEFFICIENTS OF LIFT AND DRAG OF A GOLF BALL

(75) Inventors: Burton B. Lieberman, New York, NY (US); Alexander J. Smits, Princeton, NJ (US); Steven J. Quintavalla, Bethleham, PA (US); Frank W. Thomas, Chester, NJ (US); Douglas Winfield, Mattapoisett, MA (US)

(73) Assignee: United States Golf Associates, Far Hills, NJ (US)

( * ) Notice: Under 35 U.S.C. 154(b), the term of this patent shall be extended for 0 days.

(21) Appl. No.: 09/063,568

(22) Filed: Apr. 21, 1998

(51) Int. Cl.[7] ..... A63B 37/14
(52) U.S. Cl. ..... 73/432.1
(58) Field of Search ..... 73/9, 866.4, 432.1; 364/578; 356/28; 473/131

(56) References Cited

U.S. PATENT DOCUMENTS 5,489,099 * 2/1996 Rankin et al. .
5,682,230 * 10/1997 Anfinsen et al. .
5,700,204 * 12/1997 Teder .
5,935,023 * 8/1999 Machara et al. .

* cited by examiner

*Primary Examiner*—Robert Raevis
(74) *Attorney, Agent, or Firm*—Francis C. Hand; Carella, Byrne, Bain, Gilfillan, Cecchi & Stewart & Olstein

(57) ABSTRACT

A method is provided for determining at least one of the coefficient of lift and the coefficient of drag of a golf ball for a given range of velocities and a given range of spin rates from launch. A method is also described for simulating the flight of a golf ball in a computer. A ball is launched at a selected velocity, spin rate and launch angle. Calculations are made of the x and y coordinates of the ball during flight and the coefficients of lift and/or drag are calculated mathematically in dependence on the launch velocity, spin rate, angle and calculated x and y coordinates. Repeated launchings are made to obtain a plurality of mathematically calculated values of the coefficient(s). Thereafter, an aerodynamic model for the flight of the ball is mathematically determined in dependence upon the mathematically calculated values of at least one of the coefficients relative to the velocity and spin rate.

31 Claims, 2 Drawing Sheets

METHOD FOR DETERMINING COEFFICIENTS OF LIFT AND DRAG OF A GOLF BALL

Figure 1:
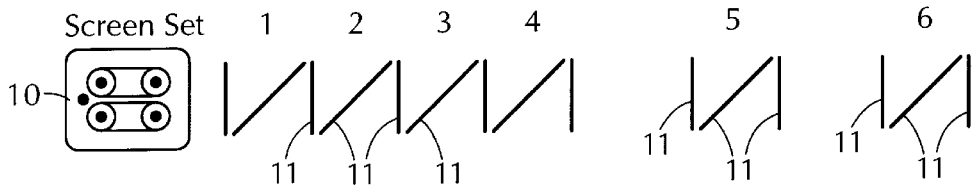

This invention relates to a method for determining the coefficients of lift and drag of a golf ball. More particularly, this invention relates to a method for simulating the flight path of a golf ball. Still more particularly, this invention relates to a method of determining the expected trajectory and roll of a golf ball.

As is known, various techniques have been known for obtaining measurements of the aerodynamic lift and drag on golf balls. As described by A. J. Smits (1994) A New Aerodynamic Model of a Golf Ball in Flight, Science and Golf II, (Ed. A. J. Cochran) E&FN SPON, pages 340–347, accurate measurements of the lift and drag characteristics of golf balls are necessary in order to predict the golf ball trajectory and its point of impact. Reference is also made to the use of wind tunnels within which a ball may be dropped to obtain the estimates of the lift and drag of a golf ball. However, one of the problems associated with using a wind tunnel to obtain measurements of the aerodynamic lift and drag of a golf ball is that the wind tunnel provides a very limited height over which a golf ball may be dropped into a horizontal flow of air within the wind tunnel. For example, there are air flow disruptions from the mechanisms used to support a golf ball within a flow of air and there are dynamic imbalances of the balls. In addition, force measurement assumptions have to be made.

Indoor test ranges developed by the research facilities of the Unites States Golf Association have also been used to measure the aerodynamic performance of golf balls. Such indoor testing range utilize spaced apart ballistic light screens through which a golf ball can be propelled at a precisely known initial velocity and spin rate in order to obtain measurements of the aerodynamic performance of the golf ball. Generally, the technics employed have been used to determine the arrival time of a ball at a number of down range stations along with the vertical and horizontal positions of the ball at each station. From this information, a trajectory program has been predicted. This technique is particularly described by M. V. Zagarola (1994) An Indoor Testing Range to Measure the Aerodynamic Performance of Golf Balls, Science and Golf II, (Ed. A. J. Cochran), E. & FN Spon, London, pages 348,354. Typically, the technique has developed aerodynamic coefficients from the information obtained from the flight path of a single ball through the ballistic screens.

U.S. Pat. No. 5,682,230 describes a calibration system for calibrating the position of the ballistic screens in an indoor test range in order to obtain more accurate information to determine the flight path of a ball.

Accordingly, it is an object of the invention to accurately measure the coefficients of lift and drag of a golf ball.

It is another object of the invention to predict and characterize the entire golf ball trajectory for an arbitrably given set of launch conditions.

It is another object of the invention to provide a mathematical model for a ball motion subsequent to landing.

It is another object of the invention to be able to calculate the overall distance, including carry and roll, for a golf ball.

It is another object of the invention to determine the optimum launch conditions that will provide a ball with the greatest overall distance.

It is another object of the invention to determine the optimal conditions for launching a ball without having to exhaust time and man power and tedious outdoor tests.

Briefly, the invention provides a method of obtaining an aerodynamic model of a golf ball. In accordance with the method the coefficient of lift as well as the coefficient of drag of a golf ball are accurately determined to predict optimum conditions for a launch angle and velocity for the golf ball. The techniques used allows a very accurate prediction to be made of the trajectory for a given golf ball. When coupled with a suitable program regarding the ground conditions, the programmed trajectory can be coupled with a program for predicting roll so that the total distance can be predicted for a golf ball under optimum launch conditions.

By being able to more accurately predict the trajectory and roll of a golf ball, a more uniform and accurate standard can be established for all golf balls.

The programs which are used to determine the trajectory of the ball may also be corrected for environment variables such as temperature, humidity, wind and barometric pressure. Further, having an accurate coefficient of lift and coefficient of drag allows for accurate predictions for trajectory and roll for a variety of launch positions. Further, optimization can be obtained for a given velocity to determine the optimum spin and optimum angle for launch.

In accordance with the invention, the technique for determining the coefficients of lift and drag of a golf ball include the basic steps of positioning a plurality of ballistic light screens in a predetermined array of vertical and angularly disposed screens along a longitudinal path with each screen being programmed for emitting an electronic pulse in response to passage of a ball through the respective screens and of launching a ball from a predetermined launch point at a predetermined speed, a predetermined spin rate and a predetermined trajectory angle through the screens.

In accordance with the method, the time of passage of the ball through each screen is recorded and calculations are performed by a suitable computer program in order to calculate an X coordinate of the ball at each screen relative to the launch point and a Y coordinate of the ball at each screen relative to a common horizontal plane.

Thereafter, in a known manner, a coefficient of lift ($C_L$) and a coefficient of draft ($C_D$) of the ball are calculated in dependence on the initial speed, spin rate, trajectory angle, times of passage through the ballistic screens, X coordinates and Y coordinates of the ball at each screen.

Basically, the above steps have been used in the past in order to calculate a coefficient of lift and a coefficient of drag for a ball. In accordance with the invention, each of the steps is repeated with a plurality of balls being launched from the launch point with each ball being launched at a different speed and different spin rate from the other balls in order to obtain a series of drag and lift coefficients in order to form an aerodynamic model of the ball.

The series of balls which are launched through the series of ballistic screens should be of the same make and model in order to obtain a coefficient and a coefficient of drag for that make and model of ball.

The results of the data gathered as a result of the series of launches through the ballistic screens is used to determine the proper lift and draft coefficient parameters using least squares identification. The resulting parameters are then used to calculate the lift and drag force for every condition of velocity and spin rate along the flight of the ball keeping in mind that the speed of the ball varies along its trajectory as does the spin rate. Having correct mathematical descriptions of the lift and drag allows one to accurately predict the flight of a golf ball. In addition, the ease of repetitive simulations allows one to determine the optimum launch conditions for the ball being tested.

Figure 2:
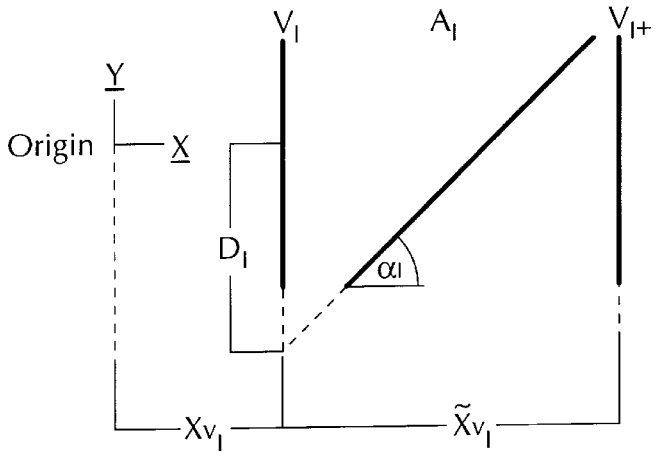
Figure 3:
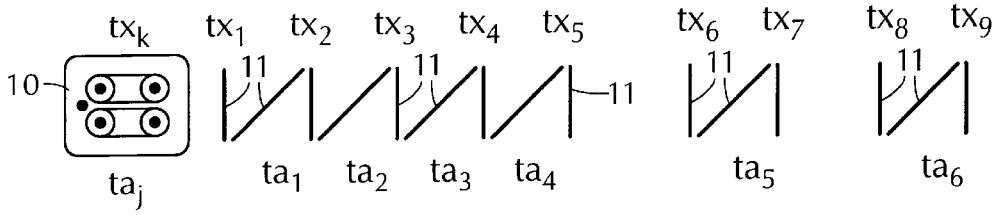
Figure 4:
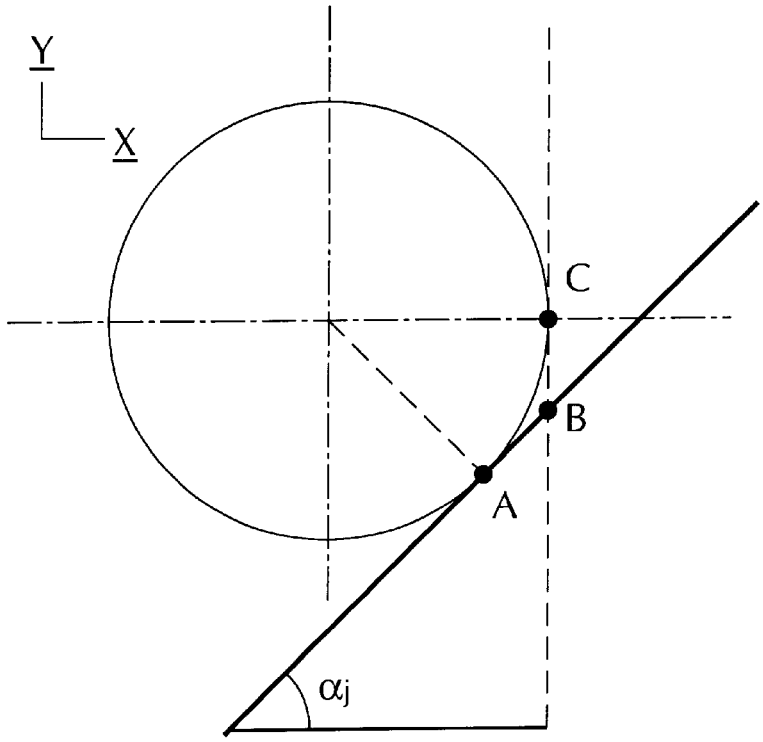
Figure 5:
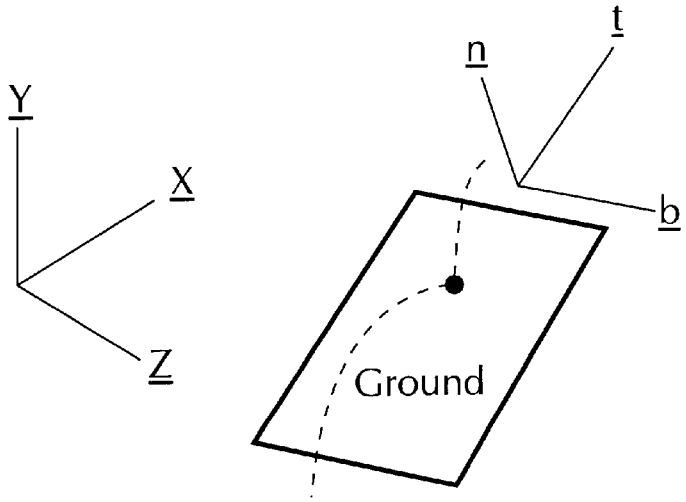

These and other objects and advantages of the invention will become more apparent from the following detailed description taken in conjunction with the accompanying drawings wherein:

FIG. 1 schematically illustrates an indoor test range including a ball launcher and a series of vertical and angularly disposed ballistic light screens utilized in accordance with the invention;

FIG. 2 schematically illustrates a light screen set of the indoor test range in accordance with the invention;

FIG. 3 schematically illustrates the manner in which calculations are made with the indoor test range to obtain the coordinates of a ball projected through the test range;

FIG. 4 graphically illustrates calculations made to determine the Y position of a ball at an angular screen; and FIG. 5 schematically illustrates a manner in obtaining the trajectory and bounce of a ball in accordance with the invention.

Referring to FIG. 1, the indoor test range (ITR) is a test facility where the aerodynamic characteristics of golf balls can be experimentally measured so that predictions for outdoor performance can be made. The ITR consists of a ball launcher 10 capable of launching a ball (not shown) at various speeds and spin rates through a series of ballistic light screens 11. Each ballistic light screen is constructed to form a screen of light (i.e. light sheet) and to produce an electronic pulse when a ball breaks the light sheet. By using digital counters, the time at which a ball passes through each of the screens can be recorded and converted into X and Y coordinates so that the trajectory of the ball during passage through the ITR can be determined. For each shot fired down the ITR, the coefficients of drag and lift can be estimated from the X and Y coordinates. The vertical screens are used to record the time of crossing for the X coordinate and the angle screens each bounded by two vertical screens are used to determine the Y coordinate by interpolation as explained below. After firing a series of shots at different velocities and spin rates, an overall aerodynamic model of the ball can be generated. Trajectory simulations can then be performed using a computer (not shown).

Software written in BASIC is used to perform all of the necessary calculations to take the raw ITR data and eventually be able to accurately model the golf ball trajectory. Although the algorithms used in the following description are written in. BASIC, this is not a necessary part of the invention. The same algorithms could easily be written in a multitude of computer languages.

The ballistic screens 11 comprising the ITR include vertical and angled screens that are distributed downstream from the launcher 10 at various points as shown in FIG. 1. The screens can be grouped into 6 sets where each set has three screens. The first four sets share screens with the adjacent sets.

It is important for the screens 11 in the ITR 10 to be in the arrangement shown. Although the analysis can be changed to accommodate other setups that could be used for other types of testing, the setup as shown in FIG. 1 has proven to be effective in measuring the aerodynamic properties of golf balls.

In order to calculate the X and Y coordinates, the position of each screen 11 must be known with respect to an arbitrary but fixed reference frame. If a screen set I is isolated as shown in FIG. 2, certain position measurements for a set of screens labeled $V_I$, $A_I$, and $V_{I+}$ must be made. The screens labeled $V_I$ and $V_{I+}$ are the vertical screens while $A_I$ is the angled or inclined screen in the set. The calibration data is based on the positions and orientation of each of the 6 screen sets where the measurements are 1. Distance $\tilde{X}v_I$ in the $\underline{X}$ direction between screens $V_I$ and $V_{I+}$:

$$\tilde{X}v_I = Xv_{I+} - Xv_I$$

where the distances in the $\underline{X}$ direction of screen $V_I$ and $V_{I+}$ from the origin are $Xv_I$ and $Xv_{I+}$, respectively 2. Distance in the $\underline{X}$ direction of screen $V_I$ from the origin: $Xv_I$
3. The angle $\alpha_I$, where $\alpha_I$ is the angle made by the inclined screen $A_I$ and the $\underline{X}$ direction
4. Coordinate $D_I$, where $D_I$ is the coordinate in the $\underline{Y}$ direction of the intersection of the screen in the Y direction and the extension of the angled screen of $A_I$.

After making the measurements for each screen set, the data can be formed into a table as shown in Table 1.

TABLE 1

| | Calibration data | | | |
|---|---|---|---|---|
| I | $\tilde{X}v_i$ | $Xv_i$ | $\alpha_i$ | $D_i$ |
| 1 | 3.9658 | −0.3018 | 44.75 | −2.13 |
| 2 | 3.9767 | 3.6640 | 45.14 | −2.17 |
| 3 | 3.9069 | 7.6407 | 45.24 | −2.25 |
| 4 | 4.2149 | 11.5476 | 45.26 | −2.40 |
| 5 | 4.0089 | 44.7976 | 45.08 | −2.10 |
| 6 | 3.9728 | 64.8842 | 44.79 | −2.10 |

The first three entries in the first column can be calculated from the information in the second column. These variables will be used to calculate the coordinates of the ball through the ITR. Table 1 can also be used in a computer program to make the necessary calculations.

The data shown above indicates the positions of the screens of the ITR used for the present disclosure. Changing the positions of the screens should not affect the final results. However, it is imperative that the screens be arranged as shown in FIG. 1.

After firing a ball through the set of ballistic screens 11, the time at which the ball passes through each screen 11 is known. As shown in FIG. 3, the times $tx_k$ (the time when the ball passes through the vertical screen k) and $ta_j$ (the time when the ball passes through the inclined screen j) along with the information about the geometric orientation of each screen must be used to find the X and Y coordinates of the ball at each angled screen during the flight down the range. The index k used herein always refers to the number of the vertical screen and the index j will always refer to the number of the screen set or the inclined screen.

After firing a ball through the ITR and recording the time at which the ball passes through each screen, a series of t and X coordinates for the vertical screens can be formed as $$(tx_k, Xv_k)_{k=1 \ldots 9}$$

where $Xv_k$ is the X coordinate for the $k^{th}$ vertical screen.

Calculation of the X Coordinates of the Ball

The X and Y coordinates of the ball during passage as it passes through the angled screens are unknown. Since the angled screens are inside pairs of vertical screens and the times at which the ball passes through the angled screens are known, the X positions of the ball at the angled screens as a function of the time the ball passes through the screens can be interpolated as $$X(t) = \sum_{k=0}^{n} Xv_k L_{n,k}(t)$$

where n is the order of the approximation polynomial which is the number of X and t coordinates minus 1 and $L_{n,k}$ is the Lagrangian interpolation polynomial. The Lagrangian interpolation polynomial $L_{n,k}$ is given by $$L_{n,k} = \prod_{\substack{i=0 \\ i \neq k}}^{n} \frac{(t - tx_i)}{(tx_k - tx_i)}$$

By substituting the time the ball passes through an angled screen $ta_j$ for t, the X coordinate $Xa_j$ can be calculated where j is the screen set number. This particular method of interpolating is known as Neville's iterated interpolation [1].

Another method for calculating the X coordinate of the ball at the angled screens is to use a linear method comprising of a linear interpolation between the two vertical screens and the angled screen in a set. The equations to calculate the X coordinate of the ball at each angled screen is given by the following equations:

$$\tilde{X}a_1 = \frac{ta_1 - tx_1}{tx_2 - tx_1}\tilde{X}v_1,$$

$$\tilde{X}a_2 = \frac{ta_2 - tx_2}{tx_3 - tx_2}\tilde{X}v_2,$$

$$\tilde{X}a_3 = \frac{ta_3 - tx_3}{tx_4 - tx_3}\tilde{X}v_3,$$

$$\tilde{X}a_4 = \frac{ta_4 - tx_4}{tx_5 - tx_4}\tilde{X}v_4,$$

$$\tilde{X}a_5 = \frac{ta_5 - tx_6}{tx_7 - tx_6}\tilde{X}v_5, \text{ and}$$

$$\tilde{X}a_6 = \frac{ta_6 - tx_8}{tx_9 - tx_8}\tilde{X}v_6.$$

Both Neville's method and the linear method will yield similar results if the calibration of the ITR is accurate. Neville's method is a higher order interpolation method that is more accurate than the linear method but could yield erroneous results if the calibration is not accurate.

Calculation of the Y Coordinates of the Ball

When the ball intersects the vertical screen, the time recorded corresponds to the position of the leading point of the ball. As shown in FIG. 4, when the ball passes through an angled screen, point A on the ball causes the screen to trip. If an imaginary vertical screen were located at point C on the ball, the imaginary vertical screen would trip the same time as that of the angled screen. Therefore, we can calculate the $Xa_j$ coordinate of point C on the ball by the method above. The calculation of the coordinate in the Y direction $Ya_j$ has to be made relative to point C on the ball. By knowing $\tilde{X}a_j$, $\alpha_j$, and the radius R of the ball, the y coordinate at point C on the ball can be calculated as $$Ya_j = \tilde{X}a_j \tan(\alpha_j) + D_j + R\tan\left(\frac{90° - \alpha_1}{2}\right)$$

where $\tilde{X}a_j$ is the distance in the X between the first vertical screen and the computed X-position of the ball in the angled screen, as given by the previous set of (6) equations.

The screens in the ITR should be arranged in the manner shown in FIG. 1. The software can easily be written to accommodate other setups that could be used for other types of testing. However, the setup as shown in FIG. 1 is the preferred setup to measure the coordinates of the ball.

Once the coordinates and times of the ball are determined, the aerodynamic properties of the balls can be calculated. These calculation are necessary so that subsequent trajectory simulations on the balls can be done. A computer program ITR.BAS has been written to perform the necessary calculations. A description of ITR.BAS is presented below.

In order to extract the aerodynamic properties of the ball, the trajectory of the ball through the ITR will have to be described. The differential equations for the X and Y positions of a golf ball traveling through the ITR can be written as $$\ddot{X} = -\frac{\rho A}{2m_B}|V|^2\{C_D\cos(\theta) + C_L\sin(\theta)\}$$

$$\ddot{Y} = \frac{\rho A}{2m_B}|V|^2\{C_L\cos(\theta) - C_D\sin(\theta)\} - g$$

where $\ddot{X}$ and $\ddot{Y}$ are the second derivatives of the position of the ball with respect to time, g is the acceleration of gravity acting in the Y direction, $m_B$ is the mass of the ball, A is the cross-sectional area of the golf ball, ρ is the density of air, $C_D$ is the coefficient of drag, and $C_L$ is the coefficient of lift. Also, |V| is the magnitude of the velocity of the ball and θ is the trajectory angle where $$|V| = \sqrt{V_X^2 + V_Y^2} \text{ and } \theta = \tan^{-1}\left(\frac{V_Y}{V_X}\right)$$

where $V_X$ is the velocity of the ball in the X direction and $V_Y$ is the velocity of the ball in the Y direction. For the ball trajectory through the ITR and for this example, the coefficients $C_D$ and $C_L$ will be assumed to be constant. The ball trajectory through the ITR can be calculated after assuming an initial velocity $V_0$, initial trajectory angle $\theta_0$, drag coefficient $C_D$, and lift coefficient $C_L$ by integrating the differential equations numerically using a Runge Kutta method.

The angular velocity does not significantly change down the 70 foot ITR. Smits [2] gave a differential equation for the angular velocity or the spin decay of the ball as $$\dot{\omega} = SRD = \frac{\omega|V|}{r}$$

where ω is the magnitude of the spin rate of the ball in radian per second, $\dot{\omega}$ is the derivative with respect to time of ω, |V| is the magnitude of the velocity of the ball, SRD is a constant which is taken to equal −0.00002, and r is the radius of the ball. The initial conditions for spin $\omega_0$ must be known to solve the equation. The spin rate ω in radians per second is equal to 2πS where S is the spin rate in revolutions per second.

Calculating $C_D$ and $C_L$

The goal is to find the values of $V_0$, $\theta_0$, $C_D$, and $C_L$ that best fit the X and Y coordinates of the ball at each of the times $t_1 \ldots t_9$ and $t_1 \ldots t_9$ as measured by the ITR. Thus, an iterative optimization method must be used to find the optimal estimates of $V_0$, $\theta_0$, $C_D$, and $C_L$.

The optimization method used is a Newton Raphson search applied to an overdetermined system of equations [1].

Let the state vector $\{x\}^i$ represent the values of the unknown variables $V_0$, $\theta_0$, $C_D$, and $C_L$ at iteration number I, that is $$\{x\}^i = \begin{Bmatrix} v_0 \\ \theta_0 \\ C_D \\ C_L \end{Bmatrix}.$$

The values for $\{x\}^i$ will be updated after every iteration in the optimization routine where the new values of $\{x\}^{i+1}$ are given by $$\{x\}^{i+1}=\{x\}^i+\{\Delta x\}^i.$$

The values of $\{\Delta x\}^i$ at each iteration are given by $$\{\Delta x\}^i=([J^i]^T[J^i])^{-1}[J^i]^T\{F\}^i$$

In general, $\{F\}^i$ represents the system to be minimized. The elements of the vector $\{F\}^i$ are the differences in the calculated values of the positions of the ball from integrating the equations and the measured values from the ITR that is $$\{F\}^i = \begin{Bmatrix} \Delta Xv_k \\ \vdots \\ \Delta Xa_j \\ \vdots \\ \Delta Ya_j \\ \vdots \end{Bmatrix}$$

where $\Delta Xv_k$ is the difference between the calculated and measured values of $Xv_k$, $\Delta Xa_j$ is the difference between the calculated and measured values of $Xa_j$, and $\Delta Ya_j$ is the difference between the calculated and measured values of $Ya_j$.

The matrix $[J^i]$ represents the Jacobian or the matrix of the derivatives of the system of equations with respect to each of the unknown variables $$[J^i] = \begin{bmatrix} \frac{\partial(Xv_k)}{\partial V_0} & \frac{\partial(Xv_k)}{\partial \theta_0} & \frac{\partial(Xv_k)}{\partial C_D} & \frac{\partial(Xv_k)}{\partial C_L} \\ \vdots & \vdots & \vdots & \vdots \\ \frac{\partial(Xa_j)}{\partial V_0} & \frac{\partial(Xa_j)}{\partial \theta_0} & \frac{\partial(Xa_j)}{\partial C_D} & \frac{\partial(Xa_j)}{\partial C_L} \\ \vdots & \vdots & \vdots & \vdots \\ \frac{\partial(Ya_j)}{\partial V_0} & \frac{\partial(Ya_j)}{\partial \theta_0} & \frac{\partial(Ya_j)}{\partial C_D} & \frac{\partial(Ya_j)}{\partial C_L} \\ \vdots & \vdots & \vdots & \vdots \end{bmatrix}.$$

The derivatives of $Xv_k$ can be calculated using a central difference approximation where $$\frac{\partial(Xv_k)}{\partial V_0} = \frac{Xv_k\left(V_0+\frac{h}{2}, \theta_0, C_D, C_L\right) - Xv_k\left(V_0-\frac{h}{2}, \theta_0, C_D, C_L\right)}{h},$$

$$\frac{\partial(Xv_k)}{\partial \theta_0} = \frac{Xv_k\left(V_0, \theta_0+\frac{h}{2}, C_D, C_L\right) - Xv_k\left(V_0, \theta_0-\frac{h}{2}, C_D, C_L\right)}{h},$$

$$\frac{\partial(Xv_k)}{\partial C_D} = \frac{Xv_k\left(V_0, \theta_0, C_D+\frac{h}{2}, C_L\right) - Xv_k\left(V_0, \theta_0, C_D-\frac{h}{2}, C_L\right)}{h},$$

-continued and $$\frac{\partial(Xv_k)}{\partial C_L} = \frac{Xv_k\left(V_0, \theta_0, C_D, C_L+\frac{h}{2}\right) - Xv_k\left(V_0, \theta_0, C_D, C_L-\frac{h}{2}\right)}{h}$$

where h is the finite difference interval which is a small number. The derivatives of $\Delta Xa_j$ and $\Delta Ya_j$ can be calculated in the same way.

As with the case with all optimization methods, good initial guesses for $\{x\}^i$ will result in quick convergence. Initial guesses for $\theta_0$ and $V_0$ can be made knowing the X and Y coordinates of the first set of screens as $$\theta_0 \approx \tan^{-1}\left(\frac{Ya_2 - Ya_1}{Xa_2 - Xa_1}\right)$$

and $$V_0 \approx \frac{Xa_2 - Xa_1}{(ta_2 - ta_1)\cos(\theta_0)}$$

It is imperative to the success of this method that a good initial guess be made, given its inherently low radius of convergence. After a few iterations, $\{x\}^i$ usually converges so that $\{\Delta x\}^i$ is less than $10^{-6}$. In every case, this method has shown to be effective. In fact, when the method does not converge, that usually means that there is an electronic malfunction of the ballistic screens resulting in a erroneous time measurement.

Dimensional analysis by Smits [2] showed that the Reynold's number Re and the spin ratio SR are important, where $$Re = \frac{2|V|R}{v}$$

and $$SR = \frac{\omega R}{|V|}$$

where R is the radius and ν is the kinematic viscosity of air which is a function of the temperature T in degrees Fahrenheit and the air density in slugs per foot$^3$ $$v = \frac{232.9*(T+459.9)^{1.5}}{\rho(T+675.9)}10^{-10}.$$

The density of air (ρ) is a function of Temperature (T), the barometric pressure (BP) in inches of mercury, and the relative humidity (RH) in percent where $$\rho = .00231 + \frac{(0.144 - 0.0002*(T-50))*(BP-30.12)}{1800} - \frac{0.005*(T-75)}{1000} - \frac{(0.01+0.0005*(T-50))*(RH-45)}{90000}$$

It is important to measure the temperature, barometric pressure, and humidity so that accurate calculations of Re can be made.

Once the optimal values for $V_0$, $\theta_0$, $C_D$, and $C_L$ are mathematically calculated, the values for $C_D$ and $C_L$ have to be related to the Re and SR for that shot. The $C_D$ and $C_L$ are assumed to be constant while the Re and SR change over the length of the ITR. The Re and SR achieve their average values approximately at one half the time the ball takes to travel the entire length of the ITR or approximately at $$\frac{tx_9}{2}.$$

A computer program, hereinafter, Program ITR.BAS is used to print out the Re, SR, $C_D$ and $C_L$ for each shot. After sufficient data has been taken at various ball speeds and spin rates, the $C_D$ and $C_L$ data will be used to form an aerodynamic model of the ball.

One of the assumptions made was that $C_D$ and $C_L$ were constant through the range of the ITR. The longer the range of the ITR and the slower the ball is fired down the ITR, the less valid the assumption becomes.

Once data points are taken in the ITR and the drag and lift coefficients are calculated, an aerodynamic model of the ball can be formed. A least squares regression on the data points is used to form an equation for the drag and lift properties of the ball for a typical drive. A computer program REG.BAS is used to perform the necessary calculations. A description of REG.BAS will be presented below.

After testing at various speeds and spin rates, an aerodynamic model of the drag and lift properties of a golf ball for a typical golf drive are determined to be $$\overline{C_D}=\bar{A}+\hat{B}\ SR^2+\bar{C}\ Re+\bar{D}\ Sr$$

and $$\overline{C_L}=\hat{A}+\hat{B}\ SR+\hat{C}\ Re^{-2}+\hat{D}\ SR^2$$

Each equation has 4 parameters that have to be determined from the ITR data. It has been found that a two parameter model using only A's and B's can also effectively model the drag and lift properties for most balls. Also, three parameter models using A's, B's, and C's and A's, B's, and D's have also been shown to be effective. The different combinations of the aerodynamic model will be considered as to their effectiveness in fitting the data. Some balls exhibit a phenomenon at low speeds and spin rates called "negative lift." This phenomenon which will be discussed later is where the drag coefficient greatly increases and the lift coefficient decreases close to zero or even goes negative. The above equations are not adequate to model that behavior.

In order to evaluate the parameters in the aerodynamic equations, the drag and lift coefficients at various ball speeds and spin rates are needed. A minimum of seven data points are needed to effectively obtain values for the parameters. The seven data points as shown in Table 2 represent a variety of speeds and spin rates that occur during a typical trajectory.

When taking data, it is sometimes useful to use more than 1 ball of a brand and/or fire the ball more than 1 time down the ITR. Testing 6 balls of a brand and firing each ball down the ITR 1 time is sufficient to obtain an accurate measurement of the drag and lift properties. The golf ball has a seam and a pole relative to how the ball is manufactured. Care must be taken so that each ball is oriented in the same way when loaded in the launcher.

TABLE 2

Data points needed to form the aerodynamic model of the ball

| Velocity (ft/sec) | Spin (revs/sec) |
|---|---|
| 250 | 46 |
| 250 | 23 |
| 200 | 36 |
| 150 | 47 |
| 150 | 27 |
| 100 | 43 |
| 100 | 19 |

Assume there are n data points of $Re_i$, $SR_i$, $C_{Di}$, and $C_{Li}$ where the subscript I will represent the data point number. A system of linear equations can be formed where $$[N_D]\{x_D\}=\{F_D\} \text{ and } [N_L]\{x_L\}=\{F_L\}$$

where vectors $\{x_D\}$, $\{x_L\}$, $\{F_D\}$, and $\{F_L\}$ are $$\{x_D\}=\begin{Bmatrix}\bar{A}\\ \bar{B}\\ \bar{C}\\ \bar{D}\end{Bmatrix},\ \{x_L\}=\begin{Bmatrix}\hat{A}\\ \hat{B}\\ \hat{C}\\ \hat{D}\end{Bmatrix},\ \{F_D\}=\begin{Bmatrix}C_{D1}\\ C_{D2}\\ C_{D3}\\ \vdots\\ C_{Dn}\end{Bmatrix},\ \text{and } \{F_L\}=\begin{Bmatrix}C_{L1}\\ C_{L2}\\ C_{L3}\\ \vdots\\ C_{Ln}\end{Bmatrix}.$$

and matrices $[N_D]$ and $[N_L]$ are $$[N_D]=\begin{bmatrix}1 & SR_1 & Re_1 & SR_1^2\\ 1 & SR_2 & Re_2 & SR_2^2\\ 1 & SR_3 & Re_3 & SR_3^2\\ \vdots & \vdots & \vdots & \vdots\\ 1 & SR_n & Re_n & SR_n^2\end{bmatrix} \text{ and } [N_L]=\begin{bmatrix}1 & SR_1^2 & Re_1^{-2} & SR_1\\ 1 & SR_2^2 & Re_2^{-2} & SR_2\\ 1 & SR_3^2 & Re_3^{-2} & SR_3\\ \vdots & \vdots & \vdots & \vdots\\ 1 & SR_n^2 & Re_n^{-2} & SR_n\end{bmatrix}.$$

Column 1 of both $[N_D]$ and $[N_L]$ corresponds to the A's of the equations, column 2 corresponds to the B's, column 3 corresponds to the C's, and column 4 corresponds to the D's. The matrices $[N_D]$ and $[N_L]$ shown above are for the four parameter model for the drag and lift of the ball.

The coefficient vectors $\{x_D\}$ and $\{x_L\}$ can be computed by solving an overdetermined system where $$\{x_D\}=([N_D]^T[N_D])^{-1}[N_D]^T\{F_D\},$$

and $$\{x_L\}=([N_L]^T[N_L])^{-1}[N_L]^T\{F_L\}.$$

Once the parameters have been calculated, an adjusted coefficient of determination, $R^2$ (which relates how well the curve fits the data), can also be calculated. The $R^2$ can range in value from 0.0 to 1.0 where the higher the value the better the equation fits the data. The $R^2$ for the equation determining $C_D$ is given by $R^2_{CD}$ where $$R^2_{CD}=1-\left(1-\frac{\sum_{i=1}^{n}\{\overline{C_D}(Re_i, SR_i)-\mu C_D\}^2}{\sum_{i=1}^{n}(C_{Di}-\mu C_D)^2}\right)\left(\frac{n-1}{n-n_p}\right)$$

where the function $C_D$ is evaluated at each data point ($Re_i$, $Sr_i$), $\mu C_D$ is the average value of $C_D$ over the n data points, and $n_p$ is the number of model parameters. In the same way, the $R^2$ equation for the curve fit for $C_L$ can be written. Generally speaking the $R^2$ values for the curve fits are greater than 0.9 for most balls. When the $R^2$ values for the curve fits are less than 0.9, the ball probably exhibits negative lift.

A computer program can be used to print out the parameters and the $R^2$ values for 4 different models for both the drag and the lift properties. The 4 modeling equations are $$\overline{C_D}=\bar{A}+\bar{B}\,SR^2$$

$$\overline{C_L}=\hat{A}+\hat{B}\,SR, \qquad \text{Model 1}$$

$$\overline{C_D}=\bar{A}+\bar{B}\,SR^2+\bar{C}\,Re$$

$$\overline{C_L}=\hat{A}+\hat{B}\,SR+\hat{C}\,Re^{-2}, \qquad \text{Model 2}$$

$$\overline{C_D}=\bar{A}+\bar{B}\,SR^2+\bar{C}\,Re+\bar{D}SR$$

$$\overline{C_L}=\hat{A}+\hat{B}\,SR+\hat{C}\,Re^{-2}+\hat{D}\,SR^2, \qquad \text{Model 3}$$

and $$\overline{C_D}=\bar{A}+\bar{B}\,SR^2+\bar{D}\,SR$$

$$\overline{C_L}=\hat{A}+\hat{B}\,SR+\hat{D}\,SR^2. \qquad \text{Model 4}$$

The equations that have the highest $R^2$ values can then be used to simulate the trajectory of the golf ball.

The equations for drag and lift are useful only for a limited set of launch conditions typical of a drive. Input launch conditions should be in the following ranges:

$V_0$=220 to 250 ft/sec, $\theta_0$=8 to 25 degrees, and $\omega_0$=20 to 60 revs per second.

In the next section, three-dimensional trajectory equations will be presented. The initial magnitudes of the velocity, angle and spin rate have to be in the ranges shown.

Once the equations for drag and lift have been determined, the flight of the golf ball can be simulated in the computer. A model may also be used for the golf ball bouncing on the ground. A computer program known as TRAJ.BAS is used to perform the necessary calculations. A description of TRAJ.BAS is presented below.

An inertial XYZ reference frame will be used where X is the direction down the middle of the fairway, Y is the vertical direction, and Z completes a right hand coordinate system. The velocity and angular velocity of the ball in the XYZ reference frame can be represented as vectors where $$\underline{V}=V_X\underline{X}+V_Y\underline{Y}+V_Z\underline{Z}$$

and $$\underline{\omega}=\omega_X\underline{X}+\omega_Y\underline{Y}+\omega_Z\underline{Z}.$$

If wind effects are included, the relative velocity of the ball with respect to the wind is $$\underline{V}^R=V^R{}_X\underline{X}+V^R{}_Y\underline{Y}+V^R{}_Z\underline{Z}$$

where $$V^R{}_X=V_X-V^W{}_X,$$

$$V^R{}_Y=V_Y-V^W{}_Y,$$

and $$V^R{}_Z=V_Z-V^W{}_Z.$$

The drag force acts in the direction opposite to that of the velocity vector while the lift force acts in the direction of the cross product of the spin direction vector with the velocity direction vector. The drag force in vector form is $$\underline{F_D}=\frac{-(\overline{C_D}\rho A|V^R|)\underline{V}^R}{2}$$

while the lift force is $$\underline{F_L}=\frac{\left(\frac{\overline{C_L}\rho A|V^R|}{|\omega|}\right)\underline{\omega}\times\underline{V}^R}{2}$$

where $|V^R|$ and $|\omega|$ are the magnitudes of the relative velocity and spin where $$|V^R|=\sqrt{(V_X^R)^2+(V_Y^R)^2+(V_Z^R)^2} \quad \text{and}$$

$$|\omega|=\sqrt{\omega_X^2+\omega_Y^2+\omega_Z^2}.$$

The 3 differential equations for translational motion are given as $$\ddot{X}=-\frac{\rho A|V^R|}{2m_B}\left\{\overline{C_D}V_X^R-\overline{C_L}\left(\frac{\omega_Y}{|\omega|}V_Z^R-\frac{\omega_Z}{|\omega|}V_Y^R\right)\right\},$$

$$\ddot{Y}=-\frac{\rho A|V^R|}{2m_B}\left\{\overline{C_D}V_Y^R-\overline{C_L}\left(\frac{\omega_Z}{|\omega|}V_X^R-\frac{\omega_X}{|\omega|}V_Z^R\right)\right\}-g, \text{ and}$$

$$\ddot{Z}=-\frac{\rho A|V^R|}{2m_B}\left\{\overline{C_D}V_Z^R-\overline{C_L}\left(\frac{\omega_X}{|\omega|}V_Y^R-\frac{\omega_Y}{|\omega|}V_X^R\right)\right\}$$

where X, Y and Z are the second derivatives of the position coordinates of the ball in the XYZ reference frame.

The angular velocity of the ball as given earlier is an equation relating the effect of the applied moment due to skin friction on the ball. That applied moment which is a vector acting in the same direction as that of the angular velocity vector can be separated into XYZ components resulting in $$\dot{\omega}_X=SRD\frac{\omega_X|V|}{r},$$

$$\dot{\omega}_Y=SRD\omega_Y\frac{|V|}{r}, \text{ and}$$

$$\dot{\omega}_Z=SRD\omega_Z\frac{|V|}{r},$$

where $\omega_x$, $\omega_y$ and $\omega_z$ are the derivatives with respect to time of the angular velocity components.

Once initial conditions are given for $V^R{}_X$, $V^R{}_Y$, $V^R{}_Z$, $\omega_x$, $\omega_y$, $\omega_z$, X, Y, and Z, the 6 differential equations can be numerically integrated using a Runge Kutta method [1].

Bounce Model

Once the ball lands on the ground, it bounces and then rolls until it stops. The USGA carefully maintains an outdoor range to precise specifications when testing is performed. The present bounce model was developed using the USGA facilities when the turf was in the proper testing condition.

In order to model the ball bouncing on the ground, an assumption is made that the impact follows the law of conservation of momentum. Therefore, in order to predict the conditions of the ball after impact, use is made of the impact momentum equations of a sphere colliding with an infinite mass plate. The equations of motion for the collision of the ball and the ground are written with respect the normal and tangential directions of the ground.

When the ball hits the surface of a flat fairway, pitch marks are made by the first two bounces. When the ball leaves contact with the ground, the originally flat ground has become inclined due to the pitch mark. The angle between the X-Z plane and the inclined plane tangent to the pitch-mark at the point of impact is called turftift, denoted by $\tau$. When the ball encounters wind or has sidespin, it will have a velocity component in the Z direction. In this case, the line defined by the intersection of the inclined plane with the X-Z plane will not be perpendicular to the X-axis.

Thus, the coordinate system tnb can be defined in terms of the XYZ system where n is the direction normal to the inclined plane, t is the projection of the ball's flight on the inclined plane, and h is the bi-normal direction as shown in FIG. 5. The tnb system can be written in terms of the XYZ system as $$\text{where} \quad [M] = \begin{bmatrix} \cos(\delta)\cos(\tau) & \sin(\tau) & -\sin(\delta)\cos(\tau) \\ -\cos(\delta)\sin(\tau) & \cos(\tau) & \sin(\delta)\sin(\tau) \\ \sin(\delta) & 0 & \cos(\delta) \end{bmatrix}$$

$$\text{and} \quad \delta = \tan^{-1}\left(\frac{V_Z}{V_X}\right).$$

The velocities and spins of the ball just prior to impact have to be transformed into the tnb reference frame, where the velocities are $V^0_t$ and $V^0_n$ and the spins are $\omega^0_t$, $w^0_n$ and $w^0_n$. The velocities $V^f_t$ and $V^f_n$ and the spins $\omega^f_t$ $\omega^f_n$ and $\omega^f_b$ after impact are $$V^f_n = -e_n V^0_n,$$

$$V^f_t = \frac{2}{7} R\omega^0_b + \frac{5}{7} V^0_t,$$

$$\omega^f_b = RV^f_t, \text{ and}$$

$$\omega^f_n = \omega^f_t = 0$$

where $e_n$ is the normal coefficient of restitution. It should be noted that after impact, all spin in the normal and tangential directions will be assumed to be 0. The impact equations are functions of $\tau$ as a result of transforming the velocities and spins into the tnb reference frame.

For the first bounce $e_n$ and $\tau$ are $$e_n = 0.233 - 0.003\ (|V| - 100) \text{ and}$$

$$\tau = 27°.$$

For successive bounces, $e_n$ and $\tau$ are $$e_n = 0.57 \text{ and}$$

$$\tau = 0°.$$

Once the velocities of the ball after impact with the ground are calculated, the velocities and spins have to be transformed back into the XYZ reference frame. The trajectory equations can then be used to calculate the flight of the ball after the bounce. After the first bounce, the drag and lift forces will be assumed to be zero, i.e., $$C_D = 0 \text{ and}$$

$$C_L = 0.$$

When the ball bounces, the velocity of the ball decreases due to the coefficient of restitution. Once the distance between successive points of contact with the ground is less than 6 inches, the ball is assumed to have stopped. Once the ball is assumed to have stopped, the model still indicates a nonzero tangential velocity with respect to the ground. Subsequent roll once the ball stops bouncing will be neglected since the tangential velocity is very small and since the bounce model accounts for the motion of the ball for very small bounces.

The three dimensional trajectory equation can model general motion of the ball; however, caution must be used so that the equations not be misused. Some limitations of the program are outlined below.

The equations allow input of rifling spin to the ball. Balls generally do not exhibit rifling spin coming off the clubhead. However, the drag and lift properties of the ball where the velocity and spin vectors are not orthogonal, thus exhibiting rifling spin, are unknown.

The equations of motion assume that the spin axis of the ball does not change during flight. If the spin vector were to remain perpendicular to the path of the ball, the resulting carry would change. However, for planar motion of the ball—in the X and Y directions only—the spin axis is always perpendicular to the path of the ball.

The bounce model has the same limitations as the trajectory model. If the initial conditions of the launch are within the ranges of $V_0$=[220, 250] ft/sec, $\theta_0$=[8, 15] degrees, and $\omega_0$=[20, 60] revs per second.

the bounce model will yield good results.

The overall goal is to use the ITR to measure the aerodynamic characteristics of golf balls so that predictions for outdoor performance can be made. The process for doing so requires four steps. First, the coordinates of the ball during travel down the ITR must be calculated. Second, the aerodynamic properties of the balls must be calculated from the coordinates of the balls. Third, data points of drag and lift coefficients must be taken in order that an aerodynamic model of the ball can be formed and the parameters of the equations be calculated using a least squares regression. Finally, simulations on the trajectory of golf balls and the bouncing of the ball on turf for conditions occurring during outdoor testing can be performed. Software is written in BASIC to perform all of the necessary calculations which take the raw ITR data and accurately models golf ball trajectories.

Software is written in BASIC to perform all of the necessary calculations to take the raw ITR data, and eventually model golf ball trajectories. The following provides details about each of the four programs that have been written. The four programs are:

1. XYT.BAS—calculates the position of the ball as it travels down the ITR.
2. ITR.BAS—calculates the aerodynamic properties of the balls.
3. REG.BAS—forms the aerodynamic model of the ball.
4. TRAJ.BAS—simulates the trajectory of golf balls and the bouncing of the ball on turf for conditions occurring during outdoor testing at the USGA.

The following outlines general and specific details about each of the four computer programs.

The software has been specifically written for Microsoft® QuickBASIC™ version 4.5 for MS-DOS™ systems. The programming language BASIC is useful in that it can interface with analog to digital (A/D) boards which are necessary to obtain the ITR data. However, the programs should be compatible (with some minor revisions) with most BASIC compilers. Hardware requirements include a IBM®-PC compatible computer with MS-DOS™. The size and memory of the computer should be at least that required for DOS and the BASIC compiler.

The programs were written with readability as the primary goal. Pneumonic variable names (where the name of the variable describes the variable itself) were used. Also, variables common to each program have the same name in each program. Since pneumonic variable names were used, comments inside the programs were not extensively used. It should be pointed out that computational speed was sacrificed in the programs to achieve readability. For instance, evaluation of the function $X^2+3X-4$ into variable F should be coded for maximum computational speed as: F=(X+3)*X−4. However, a certain degree of readability would be lost. In the four programs, evaluation the function F would appear in a more readable form as F=X^2+3*X−4.

The programs were written in a style similar to that of C++, Pascal, and FORTRAN. For instance, the programs were written using subroutines and functions as opposed to the classic GOSUB command in BASIC. The programs use conditional DO WHILE loops and never use the GOTO statement. The programs also appear in an outline form making it easy to track loops and statements appearing inside IF THEN, FOR NEXT, and DO WHILE structures. Also, the programs were designed in a top-down format where the path of execution is always from the top and going down. This helps the readability of the programs and allows the software to easily be re-written in another programming language. Every variable in the programs have a suffix, either %, #, or $, to indicate whether the variable is an integer, double precision, or a character, respectively.

As provided, the input/output filenames are "hard-coded" into the programs. It is left to the individual user to determine the preferred method of interface.

The first computer program needed is XYT.BAS which calculates the coordinates of the ball as it travels down the ITR. The coordinates of the ball are necessary to generate the aerodynamic model of the ball and to simulate its trajectory.

XYT.BAS consist of four subroutines. Input of the calibration data and the time data from the ITR is needed in order that the calculations can be performed. Also, output has to be generated for use in the next computer program The input to XYT.BAS is performed by two subroutines which gets input from a file:

GETINPUT—time data from the ITR

GETCAL—ITR calibration data

The calculations are performed by subroutine CALC

The output is produced by subroutine GETOUTPUT

There are four shared variable sets that are common to all of the subroutines. They are:

/SCREENS/NUM%

/WEATHER/TEMP#, HUM#, BPRES#

/BALL/SPIN#, DIAM#, MASS#/CONSTANTS/PI#, G# where the variables in the shared sets are:

NUM%—Number of screens—either 13 or 15 as shown below

TEMP#—Temperature in degrees F

HUM#—Relative Humidity in %

BPRES#—Barometric pressure in inches of mercury

SPIN#—Spin of the ball in revolutions per second out of launcher where positive values indicate backspin and negative topspin DIAM#—Diameter of the Ball in inches MASS#—Mass of the Ball in ounces PI#—Archimedes' constant: $\pi$=3.1415926535898

G#—Acceleration due to gravity in feet per second squared

Some other variables used in the programs are:

TX#( )—Times in which the ball passed each of the vertical screens in seconds

TY#( )—Times in which the ball passed each of angled screens in seconds

CAL#( )—Matrix storing the calibration data

CALCTYPE$—character either "N" or "L". "N" is for Neville's method and "L" is for linear method XSCR#( ) —Coordinates of the vertical screens in the X direction X#( )—X coordinate of the ball for each of angled screens Y#( )—Y coordinate of the ball for each of angled screens LOTNAME$—Name or description of the ball The four subroutines are GETCAL: Reads in the calibration constants into CAL# from file on channel #3

GETINPUT: Reads in LOTNAME$, TEMP#, HUM#, BPRES#, SPIN#, DIAM#, MASS#, NUM%, and TX#(I) where I=1 to NUM% from file channel #1 in the format shown in section C.

CALC: Calculates X# and Y# of the ball

GETOUTPUT: Outputs the results on to file channel #2.

The input for subroutine GETCAL is from file channel #3 while the input for subroutine GETINPUT is from file channel #1. The names of the files have to be given in the main program. For instance, the statements

OPEN "CAL.DAT" FOR INPUT AS #3

OPEN "XYT.IN" FOR INPUT AS #1 can be used to open files XYT.IN and CAL.DAT. The appropriate data has to be stored in file channels #1 and #3 XYT.BAS to work properly.

A sample calibration file for file channel #3 for subroutine GETCAL is

| I | $\tilde{X}v_i$ | $Xv_i$ | $\alpha_i$ | $D_i$ |
|---|---|---|---|---|
| 1 | 3.9658 | −0.3018 | 44.7475 | −2.1299 |
| 2 | 3.9767 | 3.6640 | 45.1366 | −2.1736 |
| 3 | 3.9069 | 7.6407 | 45.2351 | −2.2530 |
| 4 | 4.2149 | 11.5476 | 45.2598 | −2.4049 |
| 5 | 4.0089 | 44.7976 | 45.0771 | −2.0994 |
| 6 | 3.9728 | 64.8842 | 44.7930 | −2.1010 |

The corresponding variable to each number is given on the right side of the line. For input into XYT.BAS, only the numbers on the left side of the line are needed. The numbers are stored in the two dimensional array CAL# for use in the calculations.

A sample input file for file channel #1 for subroutine GETINPUT is

| LOTNAME$ | TEST_BALL |
|---|---|
| TEMP# | 71.76924 |
| HUM# | 37.57021 |
| BPRES# | 29.28452 |

-continued

| LOTNAME$ | TEST_BALL |
|---|---|
| SPIN# | 49.558877368 |
| DIAM# | 1.68 |
| MASS# | 1.62 |
| NUM% | 15 |
| TX#(1) | 0.0 |
| TY#(1) | 0.007709 |
| TX#(2) | 0.015837 |
| TY#(2) | 0.023501 |
| TX#(3) | 0.031793 |
| TY#(3) | 0.039655 |
| TX#(4) | 0.047541 |
| TY#(4) | 0.055931 |
| TX#(5) | 0.064620 |
| TX#(6) | 0.184846 |
| TY#(5) | 0.192257 |
| TX#(7) | 0.201781 |
| TX#(8) | 0.270637 |
| TY#(6) | 0.279036 |
| TX#(9) | 0.287912 |

The corresponding variable names as used in the program are given on the right side of the line. For input into XYT.BAS, only the numbers on the left side of the line are needed. The variables TX#(I) and TY#(I) refer to the screens in the ITR as given below

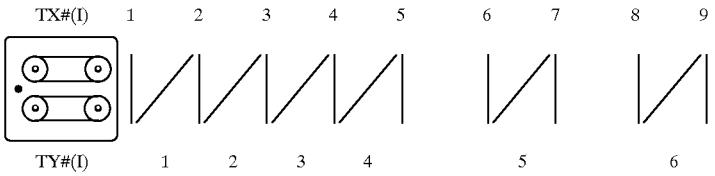

The output for subroutine XYT.BAS is from file channel #2. The name of the output file has to be given in the main program. For instance, the statement

OPEN "XYT.OUT" FOR OUTPUT AS #2 can be used to open files XYT.OUT for output. A sample output file for file channel #2 that corresponds to the data given in the sample input is:

| LOTNAME$ | TEST_BALL |
|---|---|
| TEMP# | 71.76924 |
| HUM# | 37.57021 |
| BPRES# | 29.28452 |
| SPIN# | 49.558877368 |
| DIAM# | 1.68 |
| MASS# | 1.62 |
| NUM% | 15 |

-continued

| | | | |
|---|---|---|---|
| TIME#(1), XPOS#(1), YPOS#(1) | 0 | 0 | 0 |
| TIME#(2), XPOS#(2) | .008128 | 2.03275 | |
| TIME#(3), XPOS#(3), YPOS#(3) | .015792 | 3.94506 | −.034985 |
| TIME#(4), XPOS#(4) | .024084 | 6.00945 | |
| TIME#(5), XPOS#(5), YPOS#(5) | .031946 | 7.96225 | −6.6098D-02 |
| TIME#(6), XPOS#(6) | .039832 | 9.91635 | |
| TIME#(7), XPOS#(7), YPOS#(7) | .048222 | 11.98993 | −9.4215D-02 |
| TIME#(8), XPOS#(8) | .056911 | 14.13125 | |
| TIME#(9), XPOS#(9) | .177137 | 43.16635 | |
| TIME#(10), XPOS#(10), YPOS#(10) | .184548 | 44.92338 | −0.1209 |
| TIME#(11), XPOS#(11) | .194072 | 47.17525 | |
| TIME#(12), XPOS#(12) | .262928 | 63.25295 | |
| TIME#(13), XPOS#(13), YPOS#(13) | .271327 | 65.18908 | 3.5401D-02 |
| TIME#(14), XPOS#(14) | .280203 | 67.22575 | |

(Note: Actual output has more significant digits)

The corresponding variable names as used in the program are given on the right side of the line. The indices for variables TIME#, XPOS#, and YPOS# refer to the screens as given below

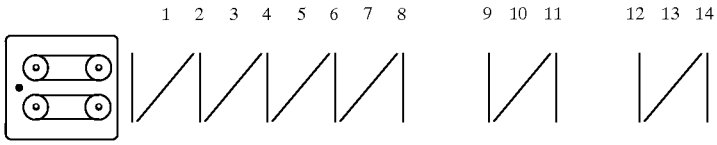

The second program needed to analyze the golf balls is ITR.BAS. This program takes the time, X, and Y coordinates of the ball passing through the ITR and calculates the drag and lift coefficients of the ball. The program simulates the trajectory of the ball and uses an optimization method to calculate the drag and lift coefficients that fit the coordinates of the ball generated by XYT.BAS. In fact, the exact output from XYT.BAS is needed to execute ITR.BAS.

The input to ITR.BAS is performed by subroutine GETINPUT which gets input from a file.

The calculations are initiated by subroutine GETCDCL where subroutines JACOBIAN, GETFUNCT, GETDIFF, CALCTRAJ, TRAJEQU, GETAB, and GUASS are called from within GETCDCL.

The output is generated by subroutine GETOUTPUT

There are four shared variable sets that are common to all of the subroutines. They are:

/SCREENS/TIME#( ), XPOS#( ), YPOS#( ), NUM%

/WEATHER/TEMP#, HUM#, BPRES#, DENS#, VISC#

/BALL/SPIN#, DIAM#, MASS#, AREA#

/CONSTANTS/PI#, G# where the variables in the shared set are:

TIME#( )—Array of the times that the ball passed each screen

XPOS#( )—Array of the X coordinates of the ball at each screen

YPOS#( )—Array of the Y coordinates of the ball at the angled screens

NUM%—Number of screens—13 or 15 as in XYT.BAS

TEMP#—Temperature in degrees F

HUM#—Relative Humidity in %

BPRES#—Barometric Pressure in inches of Mercury

DENS#—Air density in slugs per cubic feet

VISC#—Kinematic viscosity in feet squared per second

SPIN#—Spin of the ball in revolutions per second where positive values indicate backspin DIAM#—Diameter of the Ball in inches MASS#—Mass of the Ball in ounces AREA#—Cross sectional area of the ball in feet squared PI#—Archimedes' constant: $\pi$=3.1415926535898

G#—Acceleration due to gravity in feet per second squared

Two other variables used extensively in the program are:

X#( )—Holds the optimization variables $V_0$, $\theta_0$, $C_D$, and $C_L$

LOTNAME$—Character variable to hold the name of the ball

The ten subroutines are:

GETINPUT: Reads in input data

GETCDCL: Calculates the optimal values for $V_0$, $\theta_0$, $C_D$, and $C_L$ to fit the time, X and Y coordinates GETOUTPUT: Outputs Results JACOBIAN: Calculates the Jacobian which is the derivative of the difference in the measured and calculated positions at each screen with respect to the optimization variables GETFUNCT: Assembles the functions to be minimized which are the differences in the measured and calculated positions at each screen GETDIFF: Calculates the differences in the measured and calculated positions at each screen CALCTRAJ: Calculates the trajectory of the ball through the ITR using the Runge-Kutta fourth order method TRAJEQU: Holds the trajectory equations GETAB: Reduces an over-determined system of equations into a linear system of equations where the number of unknowns is equal to the number of equations GUASS: Solves a linear system of equations using the Gauss elimination method The input for subroutine GETINPUT is from file channel #1. The names of the input file has to be given in the main program. For instance, the statement

OPEN "XYT.OUT" FOR INPUT AS #1 can be used to open files XYT.OUT. The appropriate data has to be stored in file channel #1. The format of the input file is the same as that of the output file for XYT.BAS.

The output for subroutine ITR.BAS is from file channel #2. The name of the output file has to be given in the main program. For instance, the statement

OPEN "ITR.OUT" FOR OUTPUT AS #2 can be used to open files ITR.OUT for output. A sample output file for file channel #2 that corresponds to the data given in the sample input is:

| | | | | |
|---|---|---|---|---|
| TEST BALL, | 1.98953 (Re $10^{-5}$ | .090009 SR | .230910 $C_D$ | .157252 $C_L$) |

(Note: Actual output has more significant digits)

The variables in the output are LOTNAME$, $V_0$, $\theta_0$, $C_D$, and $C_L$.

The third program needed analyze golf balls is REG.BAS. This program takes a series of drag and lift coefficients of the ball and forms the aerodynamic model. This is needed to model the trajectory of the program. A series of data points of drag and lift coefficients at various speeds and spin rates is needed to calculate the parameters of the equations.

The input to REG.BAS is performed by subroutine GETINPUT which gets input from a file.

The calculations are performed by subroutines CALCDAT, GETRES, and GETR2 which call subroutines GETAB, GUASS, and GETERR.

The output is performed by subroutine GETOUTPUT.

Some variables used in the program include:

LOTNAME$—Character variable to hold the name of the ball

NPTS%—Number of data points to be curve fitted—maximum value of 100

RE#( )—Array that holds the Reynolds numbers

SR#( )—Array that holds the spin ratios

CD#( )—Array that holds the drag coefficients

CL#( )—Array that holds the lift coefficients

DAT#( )—Array used as workspace to calculate the least squares equations

NPARAM#( )—Integer array to hold the number of parameters for each equation

RES#( )—Array holds the results of the parameters for each of the equations

R2#( )—Array that holds the correlation coefficient for each equation

SSERR#( )—Array that holds the least squares error of each curve fit

The subroutines in REG.BAS are

GETINPUT: Reads in input data and calculates the number of data points. The input is a list of data including the lotname, Reynold's number, spin ratio, CD, and CL for each shot in the same form as the output from ITR.BAS. The input routine reads in data from a series of rows until the lotname changes. There should be a minimum of 7 data points and a maximum of 500 in order to perform the curvefit.

CALCDAT: Calculates the values based on the data to be used in fitting the equations.

This indexes the values in such a way as to calculate the least squares equations efficiently.

GETRES: Calculates the parameters for each of the equations.

GETR2: Calculates the parameters for each of the equations.

GETOUTPUT: Outputs the results for each of the 4 curve fits.

GETERR: Calculates the least squares error for with the data and the curve fit equations.

GETAB: Reduces an over-determined system of equations into a linear system of equations where the number of unknowns is equal to the number of equations GUASS: Solves a linear system of equations using the Gauss elimination method The input for subroutine GETINPUT is from file channel #1. The names of the input file has to be given in the main program. For instance, the statement

OPEN "REG.IN" FOR INPUT AS #1 can be used to open file REG.IN. The appropriate data has to be stored in file channel #1. The format of the input file is the same as that of the output file for ITR.BAS. Sample input for REG.BAS is (following the same format as in 4.3.4):

```
TEST_BALL, 0.80654 0.22082 0.30604 0.2819
TEST_BALL, 0.81397 0.21948 0.31529 0.2848
TEST_BALL, 0.80979 0.21547 0.30207 0.2755
TEST_BALL, 0.81608 0.21969 0.30304 0.2749
TEST_BALL, 0.81104 0.21481 0.30039 0.2736
TEST_BALL, 0.81288 0.21598 0.30053 0.2745
TEST_BALL, 0.81813 0.10320 0.22864 0.1511
TEST_BALL, 0.80950 0.09873 0.22219 0.1478
TEST_BALL, 0.81214 0.09704 0.22240 0.1433
TEST_BALL, 0.81102 0.09569 0.22304 0.1455
TEST_BALL, 0.81238 0.09407 0.22298 0.1405
TEST_BALL, 0.82111 0.09687 0.22026 0.1408
TEST_BALL, 1.22792 0.15414 0.25540 0.2147
TEST_BALL, 1.23273 0.15421 0.25514 0.2151
TEST_BALL, 1.23231 0.15346 0.25520 0.2139
TEST_BALL, 1.23240 0.15299 0.25365 0.2082
TEST_BALL, 1.23152 0.15168 0.25638 0.2154
TEST_BALL, 1.23502 0.15243 0.25743 0.2151
TEST_BALL, 1.24183 0.08928 0.22533 0.1486
TEST_BALL, 1.24445 0.08811 0.22542 0.1479
TEST_BALL, 1.25130 0.08805 0.22550 0.1448
TEST_BALL, 1.25217 0.08817 0.22484 0.1441
TEST_BALL, 1.25000 0.08723 0.22662 0.1443
TEST_BALL, 1.25238 0.08755 0.22518 0.1441
TEST_BALL, 1.60798 0.08976 0.23771 0.1593
TEST_BALL, 1.61320 0.08994 0.23363 0.1490
TEST_BALL, 1.61374 0.08955 0.23257 0.1507
TEST_BALL, 1.61453 0.08951 0.23125 0.1490
TEST_BALL, 1.61945 0.08935 0.23488 0.1529
TEST_BALL, 1.61857 0.08906 0.23322 0.1475
TEST_BALL, 1.98645 0.09373 0.23930 0.1498
TEST_BALL, 1.99719 0.09240 0.24064 0.1535
TEST_BALL, 1.99826 0.09199 0.23837 0.1488
TEST_BALL, 1.99766 0.09176 0.25389 0.1644
TEST_BALL, 1.99879 0.09172 0.23723 0.1511
TEST_BALL, 2.00309 0.09212 0.23646 0.1499
TEST_BALL, 1.97570 0.04644 0.23097 0.1155
TEST_BALL, 1.97324 0.04491 0.23014 0.1144
TEST_BALL, 1.98431 0.04470 0.23147 0.1181
TEST_BALL, 1.99051 0.04233 0.23247 0.1204
TEST_BALL, 1.98809 0.04215 0.23012 0.1113
TEST_BALL, 1.99688 0.04214 0.23136 0.1106
```

The output for subroutine REG.BAS is from file channel #2. The name of the output file has to be given in the main program. For instance, the statement

OPEN "REG.OUT" FOR OUTPUT AS #2 can be used to open files REG.OUT for output. A sample output file for file channel #2 that corresponds to the data given in the sample input is:

LOT: TEST_BALL,
NUMBER OF DATA POINTS: 42

| | A | B | C | D | R^2 |
|---|---|---|---|---|---|
| CD MODEL 1: | 0.2183 | 1.7514 | 0.0000 | 0.0000 | 0.9123 |
| CL MODEL 1: | 0.0632 | 0.9700 | 0.0000 | 0.0000 | 0.9798 |
| CD MODEL 2: | 0.1864 | 2.1275 | 0.0189 | 0.0000 | 0.9790 |
| CL MODEL 2: | 0.0637 | 1.0449 | −0.0119 | 0.0000 | 0.9878 |
| CD MODEL 3: | 0.2028 | 2.8466 | 0.0165 | −0.2159 | 0.9847 |
| CL MODEL 3: | 0.0860 | 0.6463 | −0.0122 | 1.4789 | 0.9946 |
| CD MODEL 4: | 0.2438 | 3.3238 | 0.0000 | −0.4429 | 0.9404 |
| CL MODEL 4: | 0.0847 | 0.5838 | 0.0000 | 1.4247 | 0.9857 |

Note that the models are as follows:

$$\overline{C_D}=\bar{A}+\bar{B}\ SR^2$$

$$\overline{C_L}=\hat{A}+\hat{B}\ SR, \qquad \text{Model 1}$$

$$\overline{C_D}=\bar{A}+\bar{B}\ SR^2+\bar{C}\ Re$$

$$\overline{C_L}=\hat{A}+\hat{B}\ SR+\hat{C}\ Re^{-2}, \qquad \text{Model 2}$$

$$\overline{C_D}=\bar{A}+\bar{B}\ SR^2+\bar{C}\ Re+\bar{D}\ SR$$

$$\overline{C_L}=\hat{A}+\hat{B}\ SR+\hat{C}\ Re^{-2}+\hat{D}\ SR^2, \qquad \text{Model 3}$$

and $$\overline{C_D}=\bar{A}+\bar{B}\ SR^2+\bar{D}\ SR$$

$$\overline{C_L}=\hat{A}+\hat{B}\ SR+\hat{D}\ SR^2 \qquad \text{Model 4}$$

The fourth program is TRAJ.BAS which calculates the trajectory of the golf ball. The goal of TRAJ.BAS is to calculate the distance the golf ball travels both in carry and in roll. An equation for the drag and lift of the ball is needed to model the trajectory of the program. Also, the launch conditions for the ball and the environment conditions are needed.

The input to TRAJ.BAS is performed by subroutine GETINPUT as well as the main program. The program as written does not have input from a file in order to make the program more general. It can easily be adjusted to facilitate input from a file.

The calculations are performed by subroutines CALCTRAJ and BOUNCE which call TRAJEQU, CD#, and CL#

The output is performed by subroutine GETOUTPUT.

There are four shared variable sets that are common to all of the subroutines. They are:

/WEATHER/TEMP#, HUM#, BPRES#, DENS#, VISC#, WIND#( )

/BALL/DIAM#, MASS#, AREA#

/CONSTANTS/PI#, G#

/DRAGLIFT/CDPARAM#( ), CLPARAM#( )

The variables are:

TEMP#—Temperature in degrees F

HUM#—Relative Humidity in %

BPRES#—Barometric Pressure in inches of mercury

DENS#—Air density in slugs per cubic feet

VISC#—Kinematic viscosity in feet squared per second

WIND#( )—Array that holds the wind speeds—X, Y, and Z directions

DIAM#—Diameter of the Ball in inches

MASS#—Mass of the Ball in ounces

AREA#—Cross sectional area of the ball in feet squared

PI#—Archimedes' constant: $\pi$=3.1415926535898

G#—Acceleration due to gravity in feet per second squared

CDPARAM#( )—Parameters for the equation to calculate CD

CLPARAM#( )—Parameters for the equation to calculate CL

Some other variables used in the program include:

LOTNAME$—Character variable to hold the name of the ball

TSTRT#—Time the ball is launched

TEND#—Time the ball stops

IC#( )—Array holding the initial conditions of the ball

IC#(1)=initial position of the ball in the X direction (inches)

IC#(2)=initial position of the ball in the Y direction (inches)

IC#(3)=initial position of the ball in the Z direction (inches)

IC#(4)=initial velocity of the ball in the X direction (ft./sec.)

IC#(5)=initial velocity of the ball in the Y direction (ft./sec.)

IC#(6)=initial velocity of the ball in the Z direction (ft./sec.)

IC#(7)=initial spin rate of the ball in the X direction (rps)

IC#(8)=initial spin rate of the ball in the Y direction (rps)

IC#(9)=initial spin rate of the ball in the Z direction (rps)

RES#( )—Array holding the final results after the simulation in the same order as in IC#( )

BNUM%—Number of bounces

TRAJVEL#—Ball velocity at the beginning of the trajectory (ft./sec.)

TRAJANG#—Launch angle of the ball in the XY plane (deg.)

TRAJSPIN#—Spin of the ball in the Z direction (rps)

TCARRY#—Time the ball is in flight (seconds)

CARRY#—Carry distance in the X direction (yards)

CDISP#—Carry dispersion of the ball in the Z direction (yards)

FSPIN#—Final spin of the ball (rps)

TTOTAL#—Time the ball is in flight and rolling on the ground (seconds)

TOTAL#—Total distance in the X direction of the ball (yards)

TDISP#—Total dispersion of the ball in the Z direction (yards)

DIFF#—Distance the ball travels on a bounce.(yards)

The subroutines are:

GETINPUT: Gets the values for the parameters of the drag and lift equations as well as the environmental conditions CALCTRAJ: Calculates the trajectory of the ball BOUNCE: Calculates the bounce of the ball TRAJEQU: Holds the trajectory equations CD#: Calculates the value for CD based of the curvefit parameters CL#: Calculates the value for CL based of the curvefit parameters An example of input from the main program is:

```
TRAJVEL#=235#
TRAJANG#=10#
TRAJSPIN#=42#
TSTRT#=0#
TEND#=0#
IC#(1)=0#
IC#(2)=0#
IC#(3)=0#
IC#(4)=TRAJVEL#*COS(TRAJANG#/180#*PI#)
IC#(5)=TRAJVEL#*SIN(TRAJANG#/180#*PI#)
IC#(6)=0#
IC#(7)=0#
IC#(8)=0#
IC#(9) TRAJSPIN#*2#*PI#
```

It should be noted that IC#( ) can be set to numbers without the use of TRAJVEL#, TRAJANG#, and TRAJSPIN#. An example of input from subroutine GETINPUT

```
LOTNAME$="XXX"
TEMP#=75#
HUM#=50#
BPRES#=30#
DIAM#=1.68#
MASS#=1.62#
WIND#(1)=0#
WIND#(2)=0#
WIND#(3)=0#
CDPARAM#(1)=0.20779#
CDPARAM#(2)=2.5854#
CDPARAM#(3)=0.00375#
CDPARAM#(4)=0#
CLPARAM#(1)=0.06784#
CLPARAM#(2)=1.06913#
CLPARAM#(3)=0.004715#
CLPARAM#(4)=0#
```

The program as written to output TCARRY#, CARRY#, CDISP#, TTOTAL#, TOTAL#, and TDISP#. Output of other values or the entire trajectory of the ball can easily be printed out. Results for the input as shown above is:

| | | |
|---|---|---|
| 6.3903 | 257.6400 | 0 |
| 10.8327 | 282.5578 | 0 |

(Note: Actual output has more significant digits)

The files can be contained, for example, on a distributino disk and include:

| | |
|---|---|
| XYT.BAS | - Program |
| XYT.IN | - Input file |
| XYT.OUT | - Output file |
| ITR.BAS | - Program |
| ITR.OUT | - Output file |
| REG.BAS | - Program |
| REG.OUT | - Output file |
| TRAJ.BAS | - Program |
| DOCUMENT.DOC | - Microsoft ® Word ™ file containing documentation |

Each of the four programs has input and output subroutines as well as computational subroutines. The input and output subroutines can easily be modified to produce various forms of output that are desired. The input routines can be modified so that the input data can be gathered in a different form. However, in order to guarantee the accuracy of the calculations, the computational subroutines should not be altered.

One way to implement the software into ITR testing is to arrange XYT.BAS and ITR.BAS so that after a ball is fired down the ITR, the calculations are made before the next shot is fired. In order to accomplish this, a data collection program has to be written to interface with the launcher and the ballistic screens to get the time data. The data collection program can organize the order in which balls are fired as well as the velocities and spins at which the balls are fired down the ITR. Once all of the data is taken, a sort routine can be used to sort the data based on LOTNAME. Then, the regression program can be used to form the aerodynamic model. Pseudo-code for a data collection program would appear as follows:

Preprocess: Input information about the balls: number of ball types, name of each type, number of balls of each type, diameter of each ball, and mass of each ball
Loop 1: the number of ball types used in test
Loop 2: the number of balls of each type
Loop 3: the number of speeds and spin rates used in the test
Fire Launcher
Measure temperature, barometric pressure, and relative humidity
Extract times the ball passed through each screen
Check to see if data was correctly taken (no electronic errors)
Run XYT.BAS
Run ITR.BAS
Save results in a data file for use later
Next: Loop 3
Next: Loop 2
Next: Loop 1
Sort data by ball type
Run REG.BAS
Run TRAJ.BAS It should be noted that subroutines can be written to preprocess the input information and to collect the necessary data to run XYT.BAS and ITR.BAS. The details of these subroutines are dependent on the methods and equipment used to take the measurements. In addition, the nature of the three loops in the pseudo-code depend on the type of testing performed.

The Indoor Test Range data collection system (not shown) consists of various mechanical and environmental sensors, interface hardware, and computer boards and software. The environmental sensors include temperature, humidity and barometric pressure. These sensors are fed into an A/D converter and the resultant data is either displayed on the screen or automatically collected on each test hit.

The machine sensors include rotary encoders on each motor shaft of the launcher to measure the speed of each wheel of the launcher and the resultant overall speed and spin, pressure transducers to measure the launch pressure and to detect the open or closed position of the firing breech of the launcher. These sensors are fed into a series of counter timer boards for determining wheel speed, an A/D board for the launch pressure sensor and a digital input board port for determining that breech position. A solenoid operated air valve, controlled by the PC activates the firing sequence. This is connected to a Digital output port to control the firing.

The software is written in BASIC and all timing, digital input and output, and A/D conversions are all programmed at register level.

Interface boards may be required between the various sensors and the computer boards chosen for a particular function. For example, interface boards were required between the ballistic screens and the computer timers to measure the various times between stations. This interface board takes the 15V output pulse of the ballistic screen, reduces the level, buffers the signal, and uses it to control a Dual D flip flop IC. This flip flop is set by the first ballistic screen and then reset by the second, third etc. The output of the flip flop then represents the time between the first and second screens. This output is then fed into the gate of one of the computer timing boards.

This again is only one method of interfacing the ballistic screen to the computer system. A simple counter timer could be connected to each set of screens to measure the time. It depends on the type of screens, the configuration and the method of measuring time.

In summary, by launching one ball through the Indoor Test Range at a specifric velocity setting and a specific spin setting, one can obtain a coefficient of drag ($C_D$) and a coefficient of lift ($C_L$) for that ball at those two settings. But this does not provide information of the coefficients of lift and drag where the settings for velocity and/or spin are changed. However, by launching one ball several times through the Indoor Test Range at a different velocity setting and different spin setting or launching a plurality of balls of the same manufacture, each at a different velocity setting and a different spin setting, several points can be obtained for the coefficient of drag ($C_D$) and the coefficient of lift ($C_L$). From these plurality of points, an aerodynamic model of a ball can be obtained.

That is to say, the coefficient of lift ($C_L$) may be plotted against velocity on a two-dimensional graph using the several points obtained from the launch tests to obtain a curve representative of the coefficient of lift for a range of velocities, i.e. of from 220 ft./sec. to 250 ft./sec. The coefficient of lift ($C_L$) may also be plotted against spin rate on a two-dimensional graph perpendicular to the first graph using the points obtained from the launch tests to obtain a curve representative of the coefficient of lift for a range of spin rates, i.e. from 20 to 60 resolutions per second. In a sense, the two graphs provide a three-dimensional model from which the coefficient of lift ($C_L$) can be extrapolated for a given launch velocity and spin rate within the above-stated ranges.

The coefficient of drag (($C_D$) is determined in the same manner.

The above techniques can thus be used to establish a standard for the coefficient of lift and/or the coefficient of drag for a golf ball which is to be launched at a given velocity and a given spin rate or a standard for a range of allowable coefficients of lift and/or drag for a golf ball which is to be launched at a given range of velocities and spin rates. For example, if a ball is launched through the ITR at a velocity and spin rate within the ranges specified by the established standard and has a coefficient of lift and/or drag which falls outside the range of values established by the standard, the ball can be classified as not conforming to the established standard.

[1] Burden, Richard L. and Faires, J. Douglas, *Numerical Analysis*, Third Ed. PWS-Kent Publishing, Boston, Mass., 1985.

[2] Smits, A. J. and Smith, D. R., "A New Aerodynamic Model of a Golf Ball in Flight", *Science and Golf II*, E & FN Spon, New York, 1994

What is claimed is:

1. A method of obtaining an aerodynamic model of a golf ball comprising the steps of positioning a plurality of ballistic light screens in a predetermined array of vertical and angularly disposed screens along a longitudinal path for emitting an electronic pulse in response to passage of a ball through a respective screen;

sequentially launching each of a plurality of golf balls from a predetermined launch point at different selected speeds ($V_0$), different selected spin rates ($\omega_0$) and trajectory angle ($\theta_0$) through said screens;

recording the time each ball passes through each screen;

calculating an X coordinate for each ball at each screen relative to said launch point;

calculating a Y coordinate for each ball at each screen relative to a common horizontal plane;

calculating the coefficient of lift ($C_L$) and coefficient of drag ($C_D$) for each ball in dependence on the initial velocity ($V_0$), the initial trajectory angle ($\theta_0$), spin rate ($\omega_0$) and calculated X and Y coordinates at said plurality of screens;

relating the calculated coefficient of lift ($C_L$) and coefficient of drag ($C_D$) for each ball to the Reynolds number (Re) and spin ratio (SR) of each ball; and comparing the coefficient of lift ($C_L$), coefficient of drag ($C_D$), Reynolds number (Re) and spin ratio (SR) for each ball to the others of said balls to obtain an aerodynamic model for the flight path of a ball.

2. A method as set forth in claim 1 wherein the coefficients of lift ($C_L$) and drag ($C_D$) are calculated in accordance with the formulae:

$$\ddot{X} = -\frac{\rho A}{2m_B}|V|^2\{C_D\cos(\theta) + C_L\sin(\theta)\}$$

$$\ddot{Y} = -\frac{\rho A}{2m_B}|V|^2\{C_L\cos(\theta) - C_D\sin(\theta)\} - g$$

where $\ddot{X}$ and $\ddot{Y}$ are the second derivatives of the position of the ball with respect to time, g is the acceleration of gravity acting in the Y direction, $m_B$ is the mass of the ball, A is the cross-sectional area of the golf ball, ρ is the density of air, $C_D$ is the coefficient of drag, and $C_L$ is the coefficient of lift. Also, |V| is the magnitude of the velocity of the ball and θ is the trajectory angle where $$|V| = \sqrt{V_X^2 + V_Y^2} \quad \text{and} \quad \theta = \tan^{-1}\left(\frac{V_Y}{V_X}\right)$$

where $V_X$ is the velocity of the ball in the X direction and $V_Y$ is the velocity of the ball in the Y direction.

3. A method as set forth in claim 2 wherein a least squares regression of said calculated X and Y coordinates is used to form an equation for the coefficients of lift ($C_L$) and drag ($C_D$) for each ball for a predetermined initial velocity and trajectory angle.

4. A method as set forth in claim 2 which further comprises the step of obtaining an aerodynamic model of the coefficients of lift and drag of a golf ball corresponding to the equations $$\overline{C_D} = \bar{A} + \bar{B}\,SR^2 + \bar{C}\,Re + \bar{D}\,SR$$

and $$\overline{C_L} = \hat{A} + \hat{B}\,SR + \hat{C}\,Re^{-2} + \hat{D}\,SR^2.$$

5. A method as set forth in claim 2 which further comprises the steps of obtaining data prints of the related Reynolds number ($R_e$) spin ratio (SR), coefficients of lift ($C_L$) and drag ($C_D$) for one of said balls to form a system of linear equations where $$[N_D]\{x_D\} = \{F_D\} \text{ and } [N_L]\{x_L\} = \{F_L\}$$

where vector $\{x_D\}$, $\{x_L\}$, $\{F_D\}$, and $\{F_L\}$ are $$\{x_D\} = \begin{Bmatrix} \bar{A} \\ \bar{B} \\ \bar{C} \\ \bar{D} \end{Bmatrix}, \{x_L\} = \begin{Bmatrix} \hat{A} \\ \hat{B} \\ \hat{C} \\ \hat{D} \end{Bmatrix}, \{F_D\} = \begin{Bmatrix} C_{D1} \\ C_{D2} \\ C_{D3} \\ \vdots \\ C_{Dn} \end{Bmatrix}, \text{ and } \{F_L\} = \begin{Bmatrix} C_{L1} \\ C_{L2} \\ C_{L3} \\ \vdots \\ C_{Ln} \end{Bmatrix}.$$

and matrices $[N_D]$ and $[N_L]$ are $$[N_D] = \begin{bmatrix} 1 & SR_1 & Re_1 & SR_1^2 \\ 1 & SR_2 & Re_1 & SR_2^2 \\ 1 & SR_3 & Re_1 & SR_3^2 \\ \vdots & \vdots & \vdots & \vdots \\ 1 & SR_n & Re_n & SR_n^2 \end{bmatrix} \text{ and } [N_L] = \begin{bmatrix} 1 & SR_1^2 & Re_1^{-2} & SR_1 \\ 1 & SR_2^2 & Re_1^{-2} & SR_2 \\ 1 & SR_3^2 & Re_1^{-2} & SR_3 \\ \vdots & \vdots & \vdots & \vdots \\ 1 & SR_n^2 & Re_n^{-2} & SR_n \end{bmatrix}.$$

Column 1 of both $[N_D]$ and $[N_L]$ corresponds to the A's of the equations, column 2 corresponds to the B's, column 3 corresponds to the C's, and column 4 corresponds to the D's.

6. A method as set forth in claim 5 wherein $$\{x_D\} = ([N_D]^T[N_D])^{-1}[N_D]^T\{F_D\},$$

and $$\{x_L\} = ([N_L]^T[N_L])^{-1}[N_L]^T\{F_L\}.$$

7. A method as set forth in claim 1 wherein the launch condition for each ball is selected from the following ranges:

$V_0$=220 to 250 ft/sec, $\theta_0$=8 to 25 degrees, and $\omega_0$=20 to 60 revs per second.

8. A method of determining a coefficient of lift and a coefficient of drag of a golf ball comprising the steps of positioning a plurality of ballistic light screens in a predetermined array of vertical and angularly disposed screens along a longitudinal path for emitting an electronic pulse in response to passage of a ball through a respective screen;

launching a golf ball from a predetermined launch point at a predetermined speed, a predetermined spin rate and a predetermined trajectory angle through said screens;

recording the time of passage of the ball through each screen;

calculating an X coordinate of the ball at each screen relative to said launch point;

calculating a Y coordinate of the ball at each screen relative to a common horizontal plane;

thereafter calculating a coefficient of lift ($C_L$) and a coefficient of drag ($C_D$) of the ball in dependence on said speed, spin rate, trajectory angle, times of passage, X coordinates and Y coordinates;

repeating each of said steps with the ball at different speeds and different spin rates from said launch position to obtain a series of drag and lift coefficients for the ball to form an aerodynamic model of the ball.

9. A method as set forth in claim 8 which further comprises the steps of obtaining a series of drag and lift coefficients for a plurality of balls launched from said launch point.

10. A method as set forth in claim 8 wherein the launch condition for each ball is selected from the following ranges:

$V_0$=220 to 250 ft/sec, $\theta_0$=8 to 25 degrees, and $\omega_0$=20 to 60 revs per second.

11. A method of determining at least one of the coefficient of lift and the coefficient of drag of a golf ball for a given range of velocities and a given range of spin rates from launch, said method comprising the steps of launching a ball from a launch point at a selected velocity within a given range of velocities, at a selected spin rate within a given range of spin rates and at a selected launch angle to a horizontal plane within a range of angles through a series of stations in a longitudinal flight path;

calculating an X coordinate for the ball at each said station relative to said launch point;

calculating a Y coordinate for the ball at each said station relative to a horizontal plane common to said launch point;

mathematically calculating the value of at least one of the coefficient of lift and the coefficient of drag for the ball in dependence on said selected velocity, spin rate and launch angle;

thereafter launching the ball from said launch point a plurality of times, each at a different velocity setting and a different spin rate setting and repeating said calculating steps to obtain a plurality of mathematically calculated values of at least one of the said coefficients; and thereafter plotting the plurality of calculated values relative to velocity and spin rate to obtain an aerodynamic model for the flight of the ball.

12. A method as set forth in claim 11 which further comprises the step of relating each calculated coefficient to the Reynold's number and spin ratio of the ball prior to said plotting step.

13. The method as set forth in claim 11 wherein said velocity range is from 220 ft./sec. To 250 ft./sec., said spin rate is from 20 revolutions per second to 60 revolutions per second and said launch angle is from 8° to 25°.

14. The method as set forth in claim 11 which further comprises the steps of simulating the flight of the golf ball in a computer based on the equations for lift and drag.

15. The method as set forth in claim 14 which further comprises the steps of simulating the bouncing of the ball after flight to obtain a simulation of the total flight and bouncing of a ball.

16. A method of determining at least one of the coefficient of lift and the coefficient of drag of a golf ball for a given range of velocities and a given range of spin rates from launch, said method comprising the steps of launching a ball from a launch point at a selected velocity within a given range of velocities, at a selected spin rate within a given range of spin rates and at a selected launch angle to a horizontal plane within a range of angles through a series of stations in a longitudinal flight path;

calculating an X coordinate for the ball at each said station relative to said launch point;

calculating a Y coordinate for the ball at each said station relative to a horizontal plane common to said launch point;

mathematically calculating the value of at least one of the coefficient of lift and the coefficient of drag for the ball in dependence on said selected velocity, spin rate and launch angle;

thereafter launching each of a plurality of balls sequentially from said launch point, each at a different velocity setting and a different spin rate setting, and repeating said calculating steps to obtain a plurality of mathematically calculated values of at least one of said coefficients; and thereafter plotting the plurality of calculated values relative to velocity and spin rate to obtain an aerodynamic model for the flight of said plurality of balls.

17. A method as set forth in claim 16 which further comprises the step of relating each calculated coefficient to the Reynold's number and spin ratio of the ball prior to said plotting step.

18. A method as set forth in claim 15 wherein the coefficients of lift and drag are calculated in accordance with the formulae:

$$\ddot{X} = -\frac{\rho A}{2m_B}|V|^2\{C_D\cos(\theta) + C_L\sin(\theta)\}$$

$$\ddot{Y} = \frac{\rho A}{2m_B}|V|^2\{C_L\cos(\theta) - C_D\sin(\theta)\} - g$$

where $\ddot{X}$ and $\ddot{Y}$ are th e second derivatives of the position of the ball with respect to time, g is the acceleration of gravity acting in the Y direction, $m_B$ is the mass of the ball, A is the cross-sectional area of the golf ball, ρ is the density of air, $C_D$ is the coefficient of drag, and $C_L$ is the coefficient of lift; |V| is the magnitude of the velocity of the ball and θ is the trajectory angle.

19. A method as set forth in claim 18 wherein a least squares regression of said calculated X and Y coordinates is used to form an equation for the coefficients of lift ($C_L$) and drag ($C_D$) for each ball for a predetermined initial velocity and trajectory angle.

20. A method as set forth in claim 18 which further comprises the step of obtaining an aerodynamic model of the coefficients of lift and drag of a golf ball corresponding to the equations $$\overline{C_D}=\bar{A}+\bar{B}\ SR^2+\bar{C}\ Re+\bar{D}\ Sr$$

and $$\overline{C_L}=\hat{A}+\hat{B}\ SR+\hat{C}\ Re^{-2}+\hat{D}\ SR^2.$$

21. A method as set forth in claim 18 which further comprises the steps of obtaining data prints of the related Reynolds number ($R_e$), spin ratio (SR), coefficients of lift ($C_L$) and drag ($C_D$) for one of said balls to form a system of linear equations where $$[N_D]\{x_D\}=\{F_D\} \text{ and } [N_L]\{x_L\}=\{F_L\}$$

where vectors $\{x_D\}$, $\{x_L\}$, $\{F_D\}$, and $\{F_L\}$ are $$\{x_D\} = \begin{Bmatrix} \bar{A} \\ \bar{B} \\ \bar{C} \\ \bar{D} \end{Bmatrix}, \{x_L\} = \begin{Bmatrix} \hat{A} \\ \hat{B} \\ \hat{C} \\ \hat{D} \end{Bmatrix}, \{F_D\} = \begin{Bmatrix} C_{D1} \\ C_{D2} \\ C_{D3} \\ \vdots \\ C_{Dn} \end{Bmatrix}, \text{ and } \{F_L\} = \begin{Bmatrix} C_{L1} \\ C_{L2} \\ C_{L3} \\ \vdots \\ C_{Ln} \end{Bmatrix}$$

and matrices $[N_D]$ and $[N_L]$ are $$[N_D]=\begin{bmatrix}1 & SR_1 & Re_1 & SR_1^2\\ 1 & SR_2 & Re_1 & SR_2^2\\ 1 & SR_3 & Re_1 & SR_3^2\\ \vdots & \vdots & \vdots & \vdots\\ 1 & SR_n & Re_n & SR_n^2\end{bmatrix} \text{ and } [N_L]=\begin{bmatrix}1 & SR_1^2 & Re_1^{-2} & SR_1\\ 1 & SR_2^2 & Re_1^{-2} & SR_2\\ 1 & SR_3^2 & Re_1^{-2} & SR_3\\ \vdots & \vdots & \vdots & \vdots\\ 1 & SR_n^2 & Re_n^{-2} & SR_n\end{bmatrix}.$$

Column 1 of both $[N_D]$ and $[N_L]$ corresponds to the A's of the equations, column 2 corresponds to the B's, column 3 corresponds to the C's, and column 4 corresponds to the D's.

22. A method as set forth in claim 21 wherein $$\{x_D\}=([N_D]^T[N_D])^{-1}[N_D]^T\{F_D\},$$

and $$\{x_L\}=([N_L]^T[N_L])^{-1}[N_L]^T\{F_L\}.$$

23. A method as set forth in claim 16 wherein the launch condition for each ball is selected from the following ranges:

$V_0$=220 to 250 ft/sec, $\theta_0$=8 to 25 degrees, and $\omega_0$=20 to 60 revs per second.

24. The method as set forth in claim 16 which further comprises the steps of simulating the bouncing of the ball after flight to obtain a simulation of the total flight and bouncing of a ball.

25. A method of determining at least one of the coefficient of lift and the coefficient of drag of a golf ball for a given range of velocities and a given range of spin rates from launch, said method comprising the steps of launching a ball from a launch point at a selected velocity, at a selected spin rate and at a selected launch angle to a horizontal plane through a longitudinal flight path;

calculating an X coordinate for the ball at a plurality of points corresponding to a horizontal distance from said launch point relative to a time of launch;

calculating a Y coordinate for the ball at said points corresponding to a vertical distance from said horizontal plane relative to said time of launch;

mathematically calculating the value of at least one of the coefficient of lift and the coefficient of drag for the ball in dependence on said selected velocity, spin rate, launch angle and calculated X and Y coordinates;

thereafter launching the ball from said launch point a plurality of times, each at a different velocity setting and a different spin rate setting and repeating said calculating steps to obtain a plurality of mathematically calculated values of at least one of the said coefficients; and thereafter mathematically determining an aerodynamic model for the flight of the ball in dependence on said obtained values of said at least one coefficient relative to said velocity and spin rate.

26. A method as set forth in claim 25 wherein said velocity range is from 220 ft/sec to 250 ft/sec and said spin rate is from 20 revolutions per second to 60 revolutions per second.

27. A method as set forth in claim 25 wherein said velocity range is from 100 ft/sec to 250 ft/sec.

28. A method of simulating the flight of a golf ball in a computer, said method comprising the steps of launching a ball from a launch point at different sets of launch conditions, each set of launch conditions including at least a selected velocity, a selected spin rate and a selected launch angle to a horizontal plane through a longitudinal flight path;

calculating an X coordinate for each launched ball at a plurality of points corresponding to a horizontal distance from said launch point relative to a time of launch;

calculating a Y coordinate for each launched ball at said points corresponding to a vertical distance from said horizontal plane relative to said time of launch;

mathematically calculating the value of at least one of the coefficient of lift and the coefficient of drag for each launched ball in dependence on said selected velocity, spin rate, launch angle and calculated X and Y coordinates;

generating an aerodynamic model of the launched balls based on the calculated values for the coefficients of lift and the coefficients of drag at selected launch velocities and spin rates to obtain an equation for at least one of the coefficient of lift and the coefficient of drag; and thereafter employing said aerodynamic model to simulate the trajectory of the golf ball in a computer.

29. A method as set forth in claim 28 further comprising the steps of calculating the Reynold's number (Re) and the spin ratio (SR) for each launched ball and generating said aerodynamic model in dependence on the calculated Reynold's number and spin ratio.

30. A method as set forth in claim 29 wherein said equations are $$\overline{C_D}=\bar{A}+\bar{B}\ SR^2+\bar{C}\ Re+\bar{D}\ Sr$$

and $$\overline{C_L}=\hat{A}+\hat{B}\ SR+\hat{C}\ Re^{-2}+\hat{D}\ SR^2.$$

31. A method of determining at least one of the coefficient of lift and the coefficient of drag of a golf ball for a given range of velocities and a given range of spin rates from launch, said method comprising the steps of launching a ball from a launch point at a selected velocity within a given range of velocities, at a selected spin rate within a given range of spin rates and at a selected launch angle to a horizontal plane within a range of angles through a longitudinal flight path;

calculating an X coordinate for the ball at a plurality of points in said path relative to said launch point;

calculating a Y coordinate for the ball at east said point relative to a horizontal plane common to said launch point;

mathematically calculating the value of at least one of the coefficient of lift and the coefficient of drag for the ball in dependence on said selected velocity, spin rate and launch angle and calculated X and Y coordinates;

thereafter launching each of a plurality of balls sequentially from said launch point, each at a different velocity setting and a different spin rate setting, and repeating said calculating steps to obtain a plurality of mathematically calculated values of at least one of said coefficients; and thereafter mathematically determining an aerodynamic model for the flight of the ball in dependence on said obtained values of said at least one coefficient relative to said velocity and spin rate.

* * * * *

UNITED STATES PATENT AND TRADEMARK OFFICE

CERTIFICATE OF CORRECTION

PATENT NO. : 6,186,002 B1
DATED : February 13, 2001
INVENTOR(S) : Burton B. Lieberman, et al It is certified that error appears in the above-identified patent and that said Letters Patent is hereby corrected as shown below:

Column 30, claim 18,
Line 1, change "15" to -- 16 --.

Signed and Sealed this

Second Day of October, 2001

*Attest:*

Nicholas P. Godici

NICHOLAS P. GODICI
*Acting Director of the United States Patent and Trademark Office*

*Attesting Officer*